United States Patent [19]

Lied

[11] 4,156,313

[45] May 29, 1979

[54] COMPASS HOUSING

[75] Inventor: Axel Lied, Tangstedt, Fed. Rep. of Germany

[73] Assignee: Koh-I-Noor Rapidograph, Inc., Bloomsbury, N.J.

[21] Appl. No.: 899,948

[22] Filed: Apr. 25, 1978

[30] Foreign Application Priority Data

Apr. 27, 1977 [DE] Fed. Rep. of Germany ..... 2718627

[51] Int. Cl.[2] ..... B43L 9/02

[52] U.S. Cl. ..... 33/27 B; 33/157; 33/149 H

[58] Field of Search ..... 33/27 R, 27 B, 149 R, 33/149 H, 150, 151, 152 R, 152 B, 152 C, 152 D, 153 R, 154 R, 154 B, 154 C, 154 D, 154 E, 154 F, 154 G, 155, 156 R, 156 B, 157

[56] References Cited

U.S. PATENT DOCUMENTS

| | | | |
|---|---|---|---|
| 814,453 | 3/1906 | Kern | 33/157 |
| 2,208,062 | 7/1940 | Warner | 33/27 B |
| 3,628,251 | 12/1971 | Feldl | 33/27 B |
| 3,842,508 | 10/1974 | Gentils | 33/27 B |

FOREIGN PATENT DOCUMENTS

| | | | |
|---|---|---|---|
| 434078 | 4/1948 | Italy | 33/157 |
| 449791 | 6/1949 | Italy | 33/156 R |

*Primary Examiner*—Richard E. Aegerter
*Assistant Examiner*—John W. Shepperd
*Attorney, Agent, or Firm*—David H. Semmes

[57] ABSTRACT

A compass housing of the type used for supporting a pair of adjustable compass legs in resilient contact with a spring clip. The housing includes a transverse cross-shaft as a bearing for the upper ends of the compass legs and an elongated rib, upraised to define a fulcrum for the spring clip. The housing is characterized by its unitary construction.

7 Claims, 4 Drawing Figures

COMPASS HOUSING

CROSS-REFERENCES TO RELATED APPLICATIONS

Applicant claims priority of the earlier filed West German applications Ser. Nos. P 27 18 627.2 and G 77 13 177.2, filed Apr. 27, 1977.

BACKGROUND OF THE INVENTION (1). Field of the Invention

Drafting instruments, particularly compass housings of the type supporting a spring clip in resilient contact with a pair of compass legs. A particular problem in construction of conventional compass housings is the intricate machining and fitting required to maintain the spring clips in resilient contact with the intersecting compass legs. The present construction is characterized by its simplicity and unity of construction.

(2). Description of Prior Art

Being submitted separately under the provisions of 37 C.F.R. 1.97.

SUMMARY OF THE INVENTION

According to the present invention the compass housing includes a U-shaped body portion having a pair of flat, laterally extending legs which defines an open-ended chamber for support of a spring clip. A handle extends vertically upwardly from the body and a cross-bar extends horizontally intermediate the open ends of the legs as a bearing for the upper end of a pair of compass legs. One of the housing legs is provided with an upper elongated rib as a fulcrum for the spring clip, such that the spring clip is maintained in resilient contact with the ends of the compass legs, notwithstanding the degree of bearing of the legs with respect to each other.

The invention refers to a compass housing for a spring clip compass, wherein the spring clip ends are in contact with the peripheries of the upper ends of the compass legs. The compass legs bear against a horizontal bearing shaft which extends transversely through a lower end of the housing. A handle may extend vertically upwardly from the housing.

Conventionally, the legs in such spring clip compasses have notches into which the free ends of the spring clip extends, so as to exert spring pressure onto the compass legs. This spring pressure presses the ends of the compass legs against a bearing shaft on the one hand and, on the other, retains the compass in a desired attitude apart from each other. Normally, the legs have matching indentations on their inner sides for engagement with the spring clip end. Also, of course, the spring pressure urges the legs to an open position, when the compass is being adjusted. Uncontrolled opening of the compass legs may be prevented by a securing device traversing the compass legs, such as a threaded pin with central indexing nut.

Conventionally, and in order to prevent loosening of the spring clip, the spring clip may be perforated in the central area adjacent an end of the handle, and through this perforation a bar element is introduced, which also secures the handle end. The bar element is threaded on one end and may be screwed into an appropriate tap hole in the bearing shaft. The bar element acts as a positioning device for the spring clip, and constitutes, together with the perforation in the spring clip, as well as its fastening in the bearing shaft an additional security against loosening of the spring clip either from the notches in the compass legs or a shifting of the spring clip, with reference to these notches or the bearing shaft. The bar element, furthermore, prevents an axial shifting of the bearing shaft which in the absence of such bar element has to be provided with special collars on the front sides.

DESCRIPTION OF THE PREFERRED EMBODIMENTS

Figure 1:
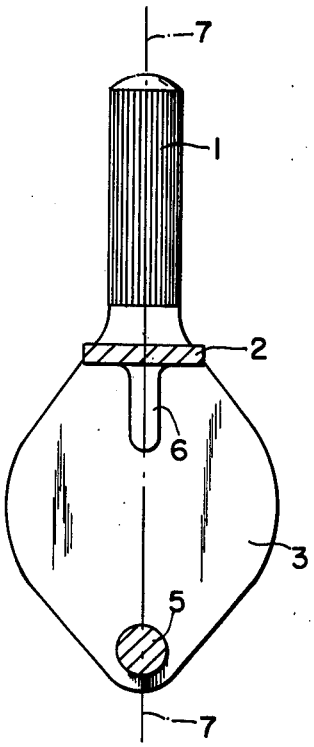
FIG. 1 is a vertical elevation, partially in section, showing the vertically extending handle, a leg of ovoidal configuration and including an elongated upper rib and a horizontal lower shaft.
Figure 2:
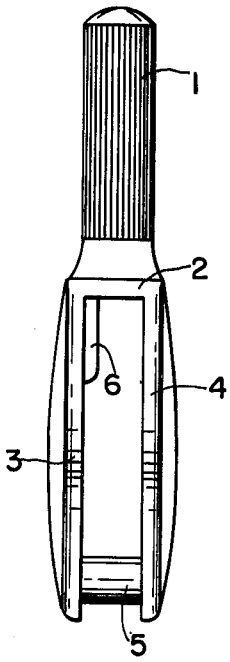
FIG. 2 is a side elevation through the housing.
Figure 3:
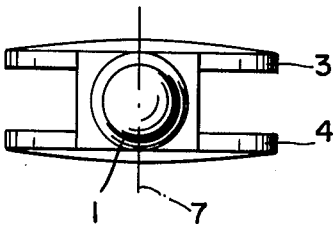
FIG. 3 is a top plan.
Figure 4:
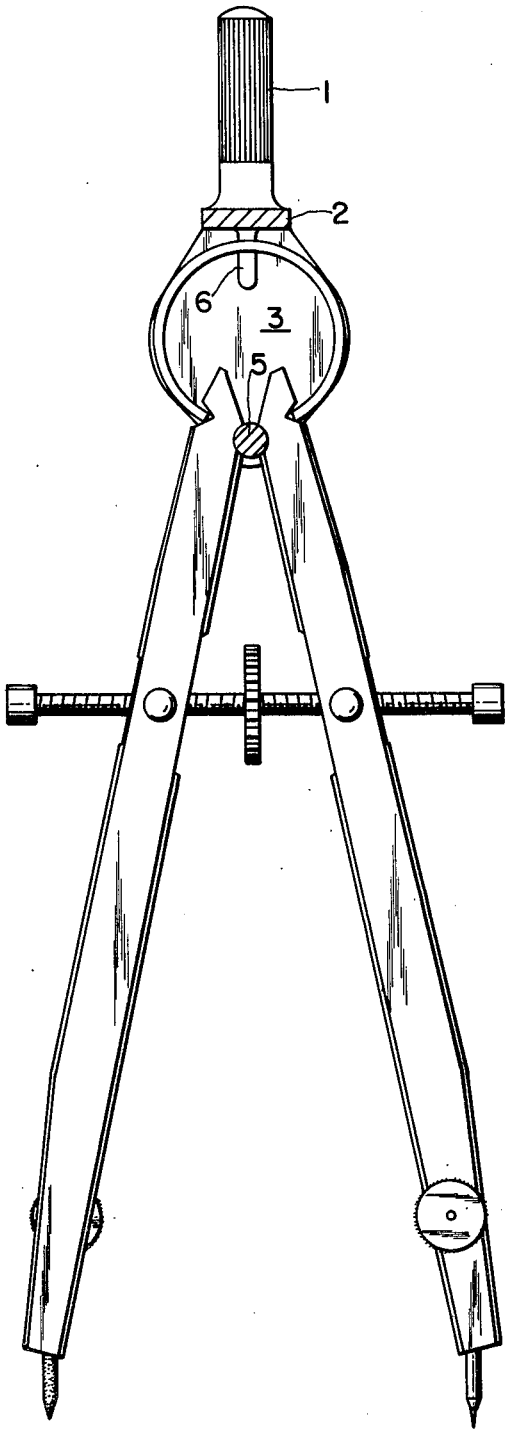
FIG. 4 is a vertical elevation, partially in section, showing that a compass with the improved housing.

In conventional compass legs, the individual parts forming the compass head, such as spring clip, bearing shaft and handle are possibly connected with the bar element, and in order to produce such a compass head, these several parts must be closely machined, e.g. the metallic bearing shaft must be especially produced and chrome-plated, and the bar element must possibly be threaded, and the shaft must receive a perforation into which a thread is also cut. Finally, all individual parts must be assembled, i.e. the bearing shaft must be brought between the end areas of the compass legs, and a resilient contact between these compass legs and the spring clip has to be established. After that the bar element of the handle must be inserted through the perforation in the spring clip, and must be screwed together with the bearing shaft and the handle must be riveted to the spring clip.

The production of such compass head is, therefore, very expensive. Accordingly, it is a purpose of the present invention to provide a more simply constructed compass head for a spring clip compass which is cheaper to produce and will require less effort to assemble.

To this end a compass housing is fitted according to the present invention in such a way that the handle is attached to a U-shaped part holding the handle and defining a pair of downwardly extending legs. A bearing shaft extends between the legs at their lower ends. A rib like supporting element is defined in the upper, inner surface of one of the legs as a fulcrum for the spring clip.

Thus, a unitary housing is provided for the spring clip, such that the upper ends of the compass legs may bear upon the transverse shaft, while engaging the spring clip. The clip, in turn, is indexed and held in place by the rib-like supporting element.

In this housing the spring clip is easily positioned upon the rib like supporting element and the upper ends areas of a pair of compass legs are joined to the bearing shaft and brought into contact with the spring clip ends, so that the number of the individual parts is considerably reduced.

The rib-like supporting element is attached to a leg in contact with an appropriate recess in the spring clip. The rib is preferably formed in one piece or integrally with the housing and, thereby prevents, because of its contact with the recess in the spring clip, a lateral shifting of the spring clip, relative to the housing legs. As a result, the spring clip is held in the desired position, while the change of shape of the spring clip is not obstructed as a result of the change of the aperture angle of the compass legs.

The compass housing according to the invention may be produced in a simple manner, especially since all its elements, i.e. handle, housing, bearing shaft and rib like supporting element, are formed in one piece. Integral production of these elements is preferably of aluminum die-cast metal or plastic, especially plastic reinforced by glass fiber. As a result, the housing may be produced by a very simple manufacturing procedure, suitable for mass production such that, practically speaking, will eliminate the necessity for reworking of the compass housing.

In FIG. 1 the compass housing is illustrated as having knurled cylindrical and edged body, which is connected in one piece with horizontal crossbar 2 securing legs 3 and 4, so as to define a U-shaped open ended housing.

Legs 3 and 4 are connected to crossbar 2 at their upper ends area and at their lower ends are connected to circular cylindrical bearing shaft 5. The longitudinal axis of bearing shaft 5 lies in the median plane 7 of the compass head. Bearing shaft 5 may be formed in one piece with legs 3 and 4.

In the upper inner surface of leg 3, the surface which is turned towards leg 4, an elongated rib 6 is defined, extending from crossbar 2, along the median plane 7 of the compass housing, as illustrated in FIG. 1.

In the illustrated example, all the afore-mentioned elements are formed integrally as one piece. As a result, the compass housing, for example, may be produced in die-cast metal, such as aluminum or in plastic injection molding, especially in plastic reinforced by glass fiber.

In order to install the compass, the spring clip, which is not illustrated, yet includes in its central area a recess on one side, is pushed between the legs 3 and 4 of the compass head, so that rib 6 extends into the recess of the spring clip. The upper ends of the compass legs are then brought into contact with bearing shaft 5, and the spring clip free ends are inserted into slots or the equivalent, defined in the outer sides of the upper ends of the compass legs. As a result, a compression is induced into the compass legs, as in the case of conventional spring clip compasses. Deformations of the spring clip are possible due to a change of the aperture angle of the compass legs during adjustment, since the recess of the spring clip moves in a vertical direction along the axis of rib 6. Rib 6, thus, prevents the spring clip from a lateral shifting.

In the illustrated example, legs 3 and 4 have a greater lateral width in their central area than in the lower area of their free ends or in the upper area of bar 2, resulting in a complete lateral housing of the inserted spring clip. As will be apparent, this construction also provides the compass housing with a pleasing design. The curvatures in the form of a sphere in the area of the outer surfaces of legs 3 and 4 further enhance this effect.

I claim:

1. A compass with an improved housing of the type used for supporting a pair of adjustable compass legs in resilient contact with a spring clip comprising:

A. A U-shaped body portion having a pair of flat laterally extending legs, defining an open-ended chamber for support of a spring clip;

B. An elongated, vertically rib defined within the interior, upper surface of one of said legs as a fulcrum for a spring clip;

C. A handle extending vertically upwardly from said body portion adjacent the closed end of said chamber;

D. A crossbar extending intermediate the lower open ends of said legs, as a bearing for the upper end of a pair of compass legs;

E. A spring clip, recessed so as to be positioned at its mid-portion upon said rib with its free ends contacting the upper ends of a pair of compass legs; and F. A pair of compass legs bearing upon said crossbar at the upper end of each leg and having slots defined in the upper end of each leg, so as to compressively engagable with said spring clip free ends.

2. A compass housing as in claim 1, said handle being knurled.

3. A compass housing as in claim 1, said crossbar extending horizontally and having a circular cross section.

4. A compass housing as in claim 3, said elongated rib having a vertical axis aligned vertically with the horizontal axis of said crossbar.

5. A compass housing as in claim 4, said handle, said elongated rib and said cross shaft being vertically aligned.

6. A compass housing as in claim 4, said pair of flat laterally extending legs being of greater lateral width in their mid-portions.

7. A compass housing as in claim 6 each of said legs having a ovoidal profile with said elongated vertical rib defined in the upper narrow surface of one of said legs and said crossbar extending intermediate the opposed lower narrow surfaces of said legs.

* * * * *